US008172989B2

(12) United States Patent
Pass

(10) Patent No.: US 8,172,989 B2
(45) Date of Patent: May 8, 2012

(54) PREVENTION OF SUBSTRATE EDGE PLATING IN A FOUNTAIN PLATING PROCESS

(75) Inventor: Thomas Pass, San Jose, CA (US)

(73) Assignee: SunPower Corporation, San Jose, CA (US)

( * ) Notice: Subject to any disclaimer, the term of this patent is extended or adjusted under 35 U.S.C. 154(b) by 707 days.

(21) Appl. No.: 12/323,157

(22) Filed: Nov. 25, 2008

(65) Prior Publication Data

US 2009/0134034 A1 May 28, 2009

Related U.S. Application Data

(60) Provisional application No. 61/004,323, filed on Nov. 26, 2007.

(51) Int. Cl.
*C25D 17/00* (2006.01)

(52) U.S. Cl. ..... 204/198; 204/227

(58) Field of Classification Search ..... 204/198, 204/227

See application file for complete search history.

(56) References Cited

U.S. PATENT DOCUMENTS

| | | | |
|---|---|---|---|
| 4,584,068 A | 4/1986 | Hinrichs et al. | |
| 5,000,827 A | 3/1991 | Schuster et al. | |
| 5,429,733 A | 7/1995 | Ishida | |
| 5,437,777 A | 8/1995 | Kishi | |
| 5,443,707 A | 8/1995 | Mori | |
| 6,001,235 A | 12/1999 | Arken et al. | |
| 6,274,024 B1 | 8/2001 | Kaufman et al. | |
| 6,312,590 B1 | 11/2001 | Isola | |
| 6,558,518 B1 | 5/2003 | Sendai et al. | |
| 6,652,726 B1 * | 11/2003 | Chou | 205/80 |
| 7,169,269 B2 * | 1/2007 | Mizohata et al. | 204/199 |

FOREIGN PATENT DOCUMENTS

| | | |
|---|---|---|
| DE | 19736340 | 2/1999 |
| DE | 60025773 | 7/2006 |
| WO | WO-2008/071239 | 6/2008 |

OTHER PUBLICATIONS

PCT International Search Report and Written Opinion of the International Searching Authority, PCT/US2008/085037 filed Nov. 26, 2008, mailed Jun. 22, 2009.

International Preliminary Report on Patentability from PCT/US2008/085037 mailed Jun. 1, 2010, 5 pgs.

* cited by examiner

*Primary Examiner* — Luan Van

(74) *Attorney, Agent, or Firm* — Blakely Sokoloff Taylor & Zafman LLP

(57) ABSTRACT

A plating apparatus and method for plating a surface of a substrate are described. Generally, the apparatus includes a double wall plating vessel having an inner cup and an outer cup peripherally surrounding and spaced apart from the inner cup. The inner cup has an inlet for receiving a plating solution and an outlet from which the plating solution overflows into a plenum defined between the inner and outer cups.

10 Claims, 6 Drawing Sheets

PREVENTION OF SUBSTRATE EDGE PLATING IN A FOUNTAIN PLATING PROCESS

CROSS REFERENCE TO RELATED APPLICATIONS

This application claims the benefit of U.S. Provisional Application No. 61/004,323, filed Nov. 26, 2007, the entire contents of which are hereby incorporated by reference herein.

TECHNICAL FIELD

Embodiments of the present invention are in the field of electroplating and, in particular, prevention of substrate edge plating in fountain plating processes.

BACKGROUND

Electroplating is an electrochemical process in which current flow through an electrolytic solution from a positively charged electrode (anode) to a work-piece deposits a thin layer or plating of metal thereon. A conventional fountain-type electroplating apparatus for plating planar work-pieces, such as semiconductor substrates, is shown schematically in FIG. 1. Referring to FIG. 1, an apparatus 100 generally includes an inner plating tank or cup 102 containing an electrolytic solution (the motion of which is indicated by the arrows), an electrolyte inlet 104 and an electroplating power supply 108. Electroplating power supply 108 is electrically coupled to an anode 110 in plating tank 102 and, via conductive supports 112, to a work-piece or substrate 114 supported above plating tank 102. Apparatus 100 may be positioned above an overflow tray for catching effluent from plating tank 102, and further above an electrolyte recirculation system or pump (not shown).

In operation, a positive charge is applied to anode 110 and a negative charge is applied to substrate 114, which serves as the cathode, through conducting supports 112. As the electrolytic solution is circulated past anode 110 toward substrate 114 by a recirculation pump, metal ions dissolved in the solution plate out on substrate 114. The source of the material to be deposited (metal ions) may be a consumable anode 110, or a non-consumable anode with a source attached thereto. Generally, when a non-consumable anode is used the metal ions come from an external source, such as an anode bag attached to the anode. In fountain plating, if a non-consumable anode is used, the anode bag may rest on the non-consumable anode.

While the above-described fountain-type electroplating apparatus provides a relatively rapid and economical approach to providing substantially uniform plating on a surface of semiconductor substrate, it does have a number of disadvantages or drawbacks. One potential drawback associated with conventional electroplating apparatuses and methods is the generally undesirable plating that occurs on a radial side or edge 116 of substrate 114 and which can, under certain circumstances, even extend to a top surface 118 thereof. Past attempts to eliminate this undesirable edge coat have focused on the use of a thick or extensive edge protection coating formed on the edge or top surface of the substrate prior to electroplating. These solutions have also not been wholly satisfactory for a number of reasons. In particular, the additional processing operations needed to deposit, pattern, develop and then strip the edge coating material, such as a photo-resist edge coating material, after electroplating can add significantly to the fabrication cost or time.

SUMMARY

Embodiments of the present invention include prevention of substrate edge plating in fountain plating processes. In an embodiment, a plating apparatus is provided along with a method for plating a surface of a semiconductor substrate that substantially eliminates the need for a protective edge coating. Generally, the apparatus includes a double wall plating vessel having an inner cup and an outer cup peripherally surrounding and spaced apart from the inner cup. The inner cup has an inlet for receiving a plating solution and an outlet from which the plating solution overflows into a plenum defined between the inner and outer cups. A plurality of supports position the substrate at a predetermined location proximal to the outlet of the inner cup such that the plating solution flowing from the outlet into the plenum passes over and plates the surface thereof. An air-knife including one or more gas outlets directs a plurality of streams of gas past the edge of the substrate and towards the plenum to substantially prevent any plating occurring on a peripheral edge or opposing surface of the substrate. Preferably, the outlets and the plurality of streams of gas are configured to provide an adjustable and substantially uniform curtain of gas around the entire periphery of the substrate. In a specific embodiment, the inner cup further includes an outer surface near the outlet, facing the outer cup that is shaped to substantially reduce accumulation of plating solution near the edge of the substrate. In one embodiment, the outer surface near the outlet of the inner cup has a beveled edge sloping towards the outlet to form a larger cavity or opening in the plenum. In another embodiment, the outer surface near the outlet of the inner cup has an undercut rim to control flow of plating solution into the plenum through surface tension.

Optionally, the apparatus may further include a plurality of ports or outlets located and oriented to direct streams of gas towards the plenum, redirecting plating solution away from the edge of the substrate, thereby further reducing plating on the edge or a top surface of the substrate. As with the air-knife, the ports or outlets are preferably configured to provide an adjustable and substantially uniform flow of gas towards the plenum around the entire periphery of the substrate. In another aspect, the invention is directed to a Bernoulli gripper for use with a plating apparatus for plating a surface of a semiconductor substrate that substantially eliminates the need for a protective edge coating.

DETAILED DESCRIPTION

An apparatus and method for prevention of substrate edge plating in fountain plating processes are described herein. In the following description, numerous specific details are set forth, such as process tool configurations, in order to provide a thorough understanding of the present invention. It will be apparent to one skilled in the art that embodiments of the present invention may be practiced without these specific details. In other instances, well-known fabrication regimes, such as plating chemical regimes, are not described in detail in order to not unnecessarily obscure embodiments of the present invention. Furthermore, it is to be understood that the various embodiments shown in the Figures are illustrative representations and are not necessarily drawn to scale.

Disclosed herein is an apparatus for plating the surface of a substrate. The apparatus may include a double wall plating vessel having an inner cup and an outer cup peripherally surrounding and spaced apart from the inner cup. In an embodiment, the inner cup includes an inlet for receiving a plating solution and an outlet from which the plating solution overflows into a plenum defined between the inner and outer cups. Also included is a plurality of supports for supporting the substrate at a predetermined position proximal to the outlet of the inner cup such that the plating solution flowing from the outlet into the plenum passes over and uniformly plates the surface of the substrate. In one embodiment, an air-knife is included to provide a plurality of streams of gas directed to flow past a peripheral edge of the substrate positioned on the plurality of supports and towards the plenum to substantially prevent any plating occurring on the edge and top surface of the substrate.

In accordance with an embodiment of the present invention, there is a need for a fountain-type electroplating apparatus and method of using the same that provides substantially uniform plating across a surface of a substrate while substantially eliminating the need for edge coating. It is further desirable that the apparatus and method does not require additional processing operations that may increase fabrication cost or time. The present invention may provide a solution to these and other problems, and may offer further advantages over conventional electroplating apparatuses and methods.

Figure 1:
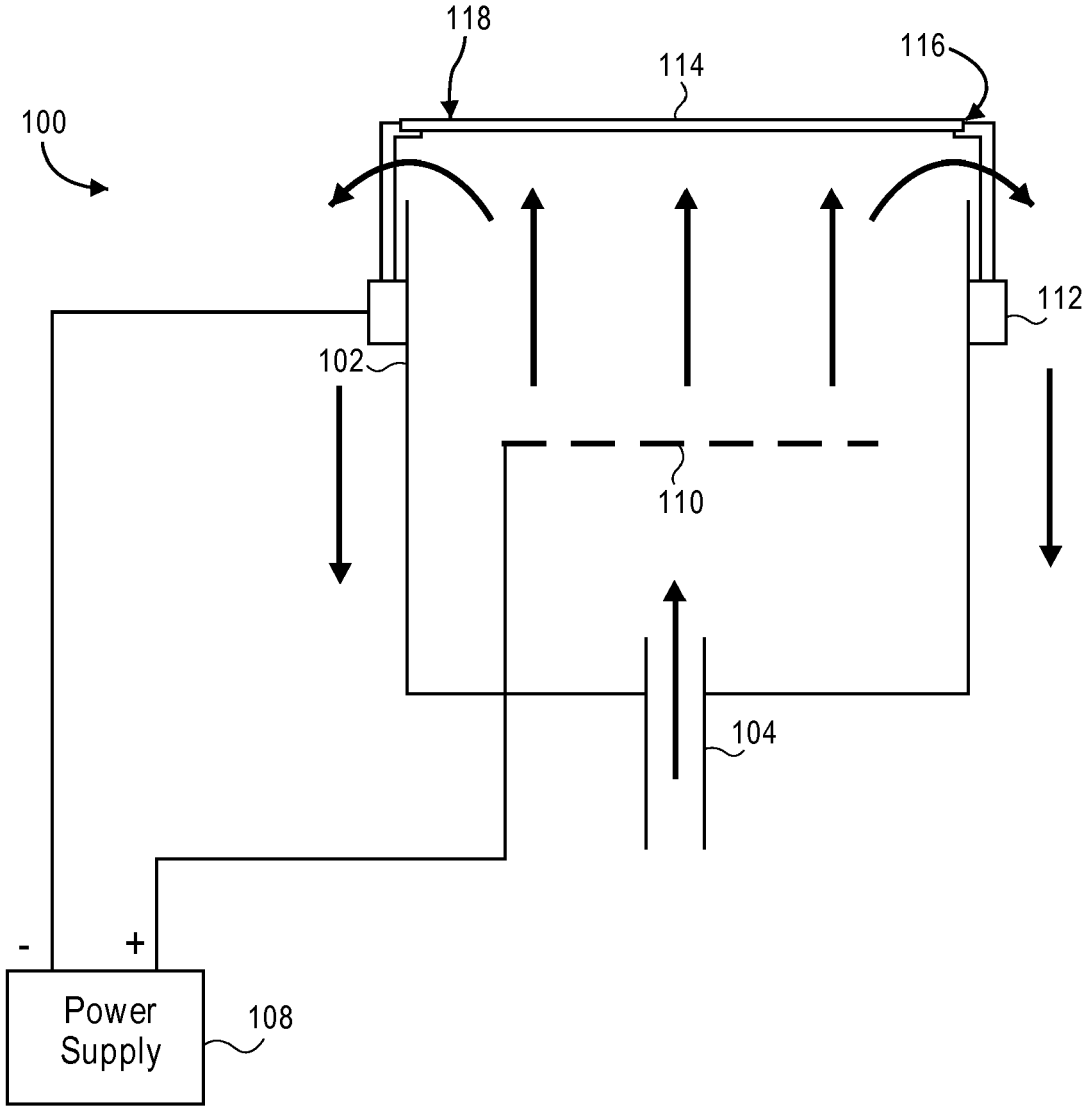
FIG. 1 (PRIOR ART)
FIG. 1 illustrates a schematic block diagram in cross-sectional side view of a conventional fountain plating apparatus for plating a surface of a substrate.
Figure 2A:
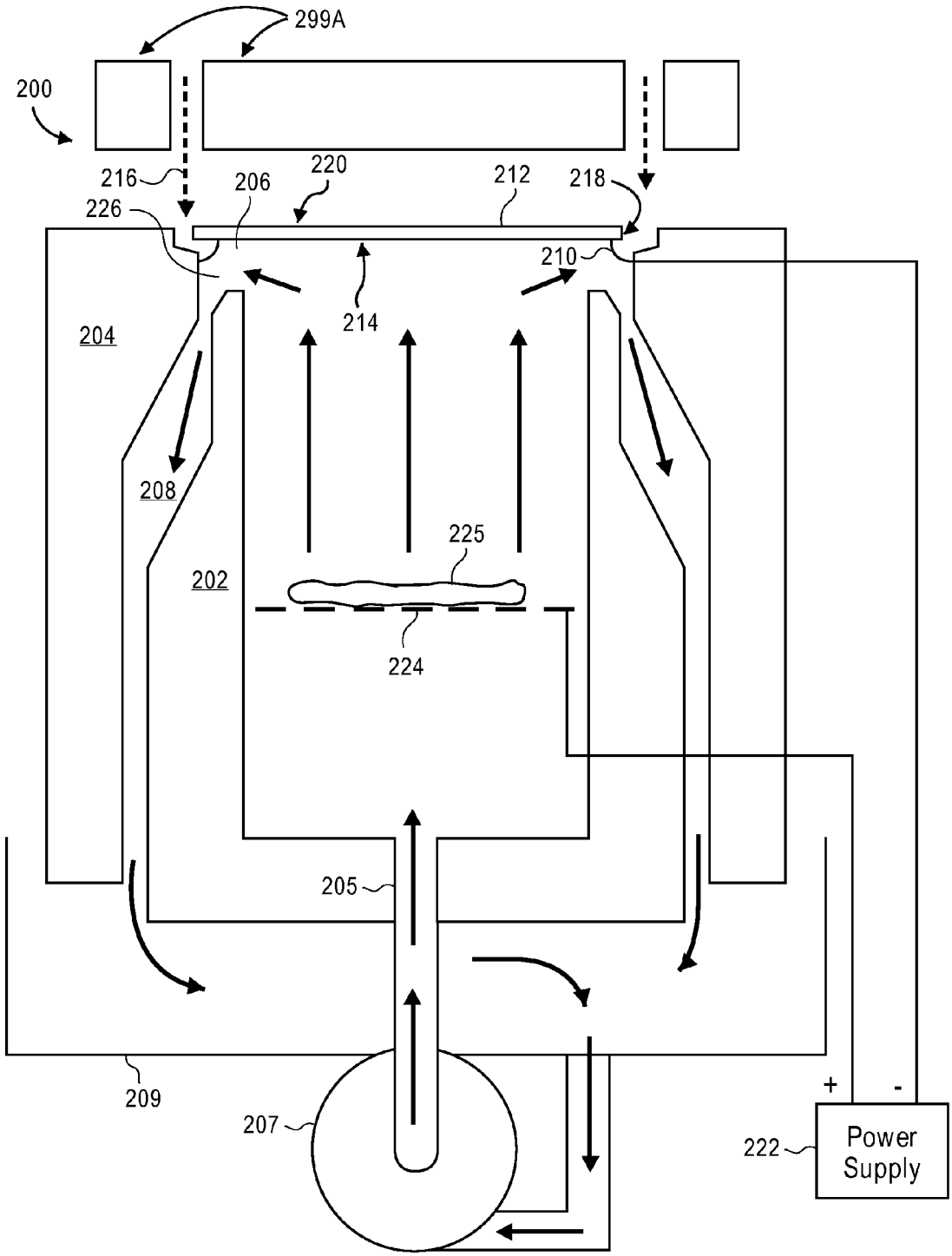
FIG. 2A illustrates a schematic block diagram in cross-sectional side view of inner and outer cups of a fountain plating apparatus for plating a surface of a substrate, in accordance with an embodiment of the present invention.
Figure 2B:
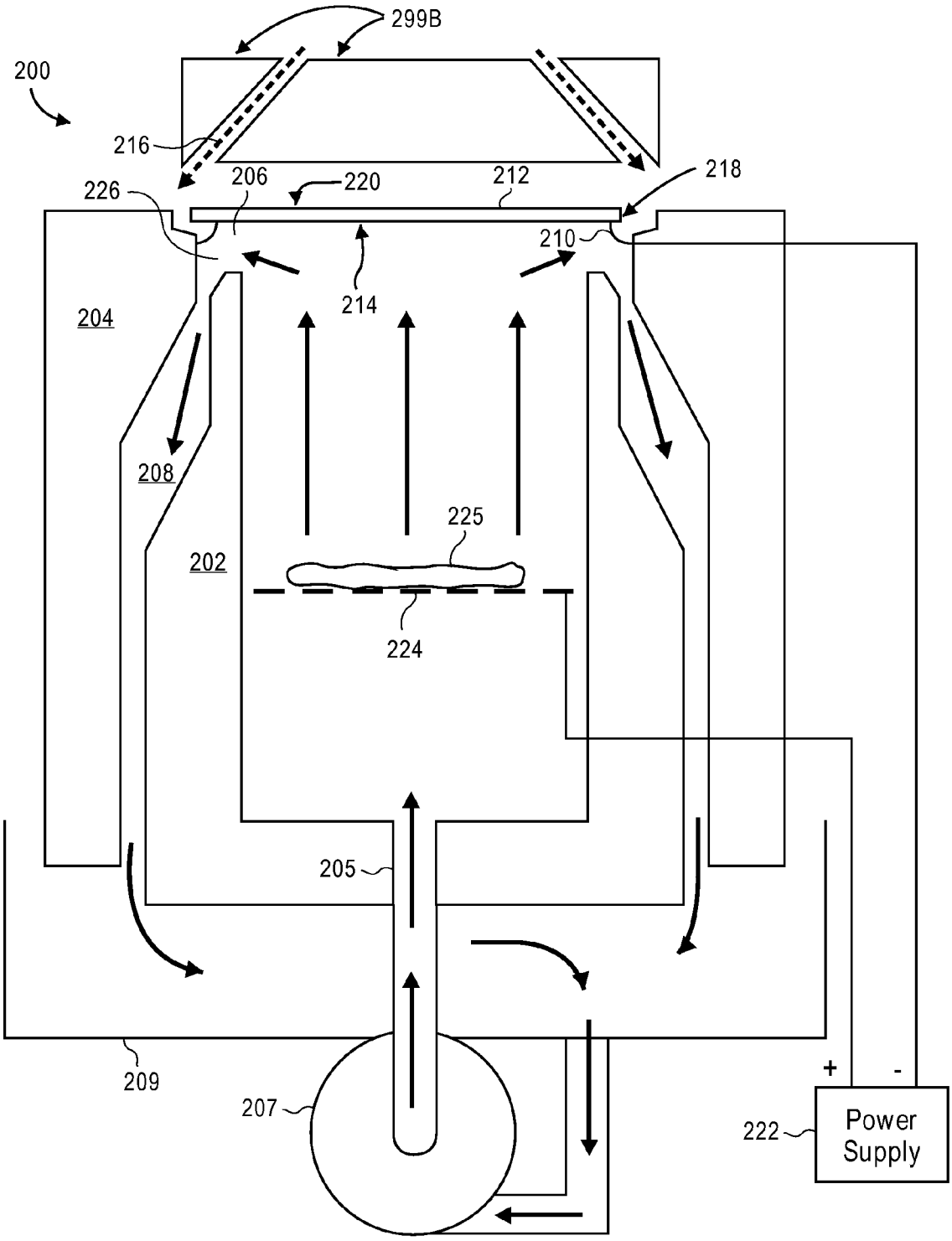
FIG. 2B illustrates a schematic block diagram in cross-sectional side view of inner and outer cups of a fountain plating apparatus for plating a surface of a substrate, in accordance with an embodiment of the present invention.
Figure 2C:
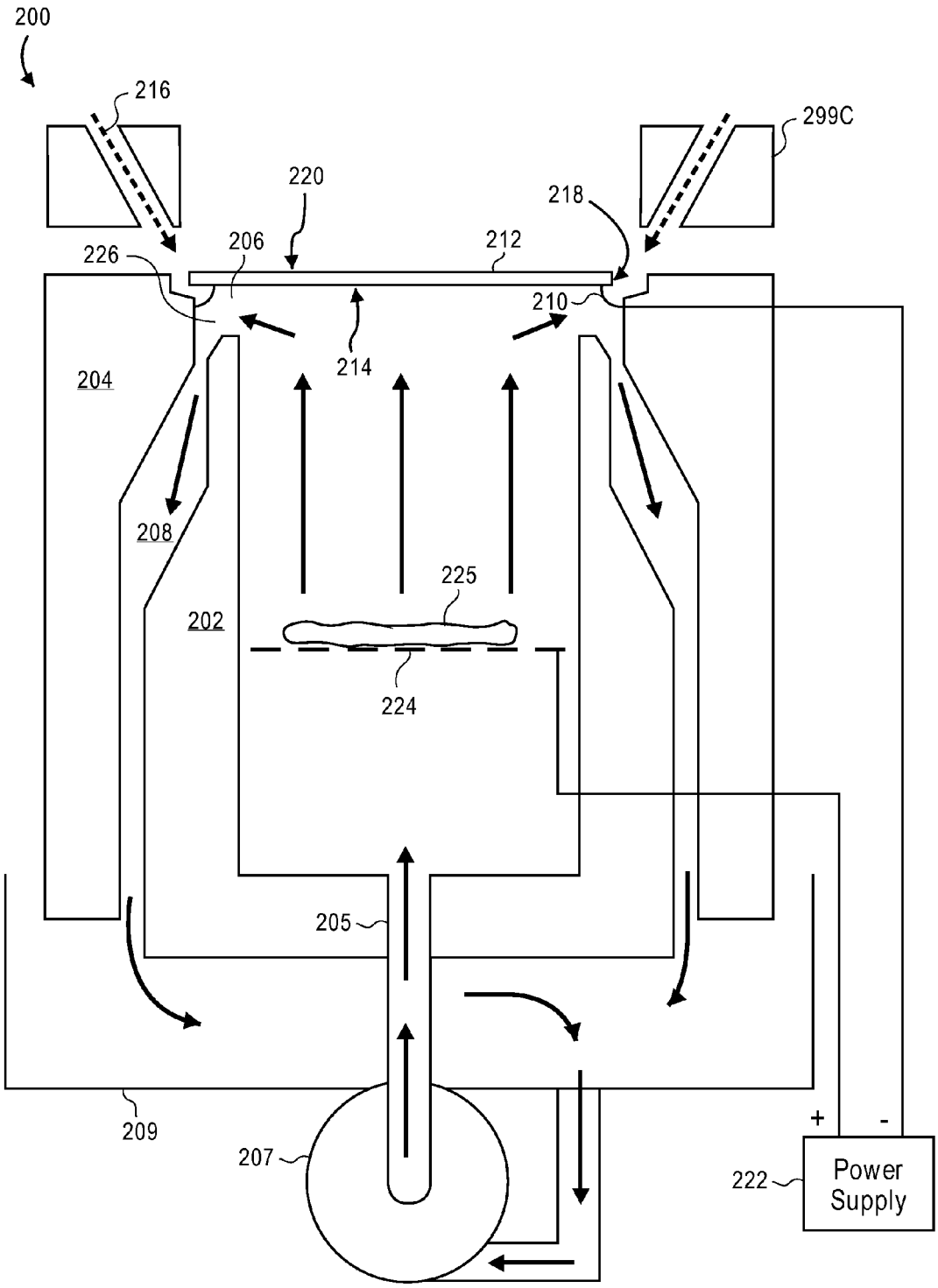
FIG. 2C illustrates a schematic block diagram in cross-sectional side view of inner and outer cups of a fountain plating apparatus for plating a surface of a substrate, in accordance with an embodiment of the present invention.
Figure 3:
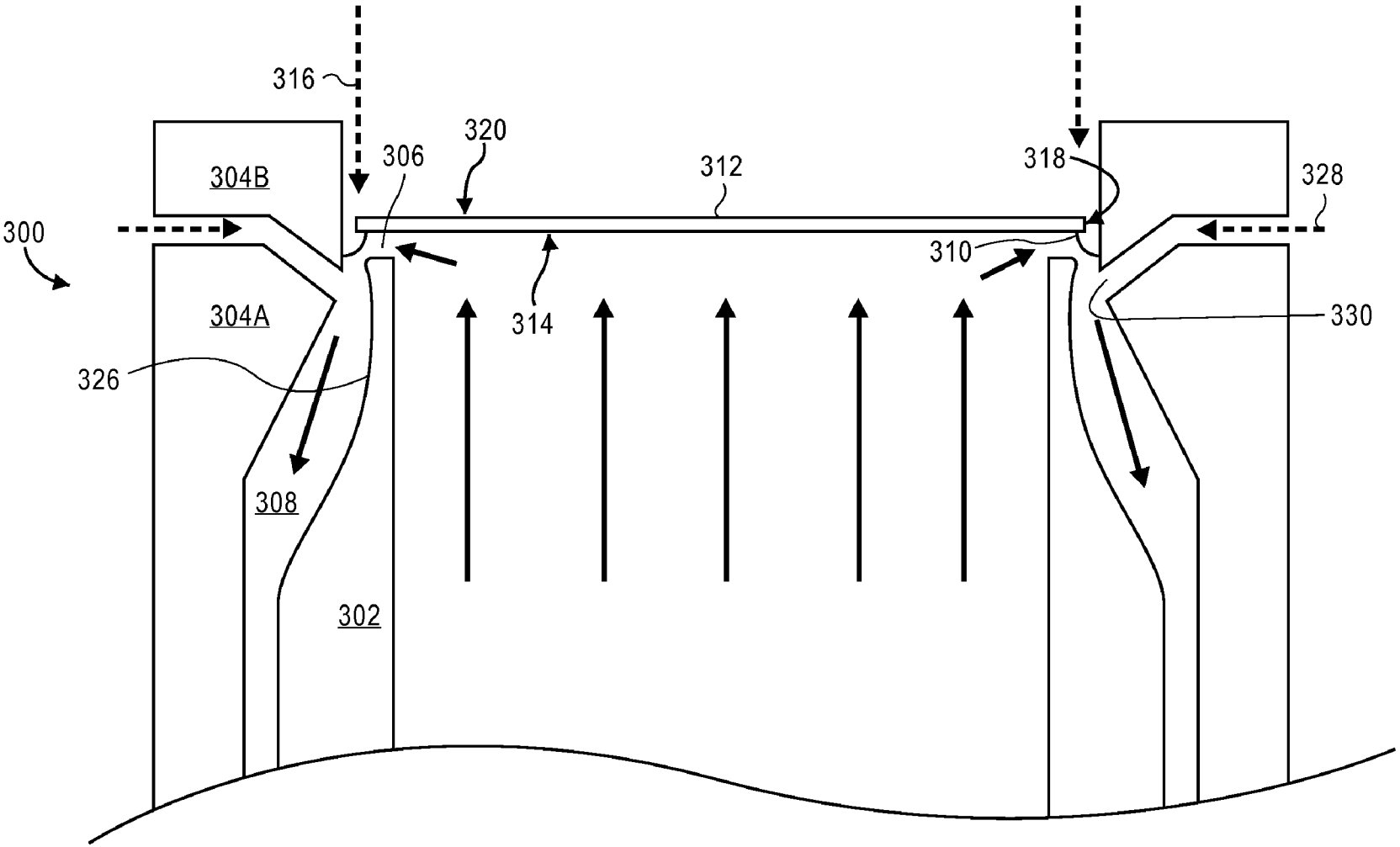
FIG. 3 illustrates a schematic block diagram in cross-sectional side view of a portion of a fountain plating apparatus having an undercut rim on an inner cup and a two portion outer cup to control chemistry at a substrate edge, in accordance with an embodiment of the present invention.
Figure 4:
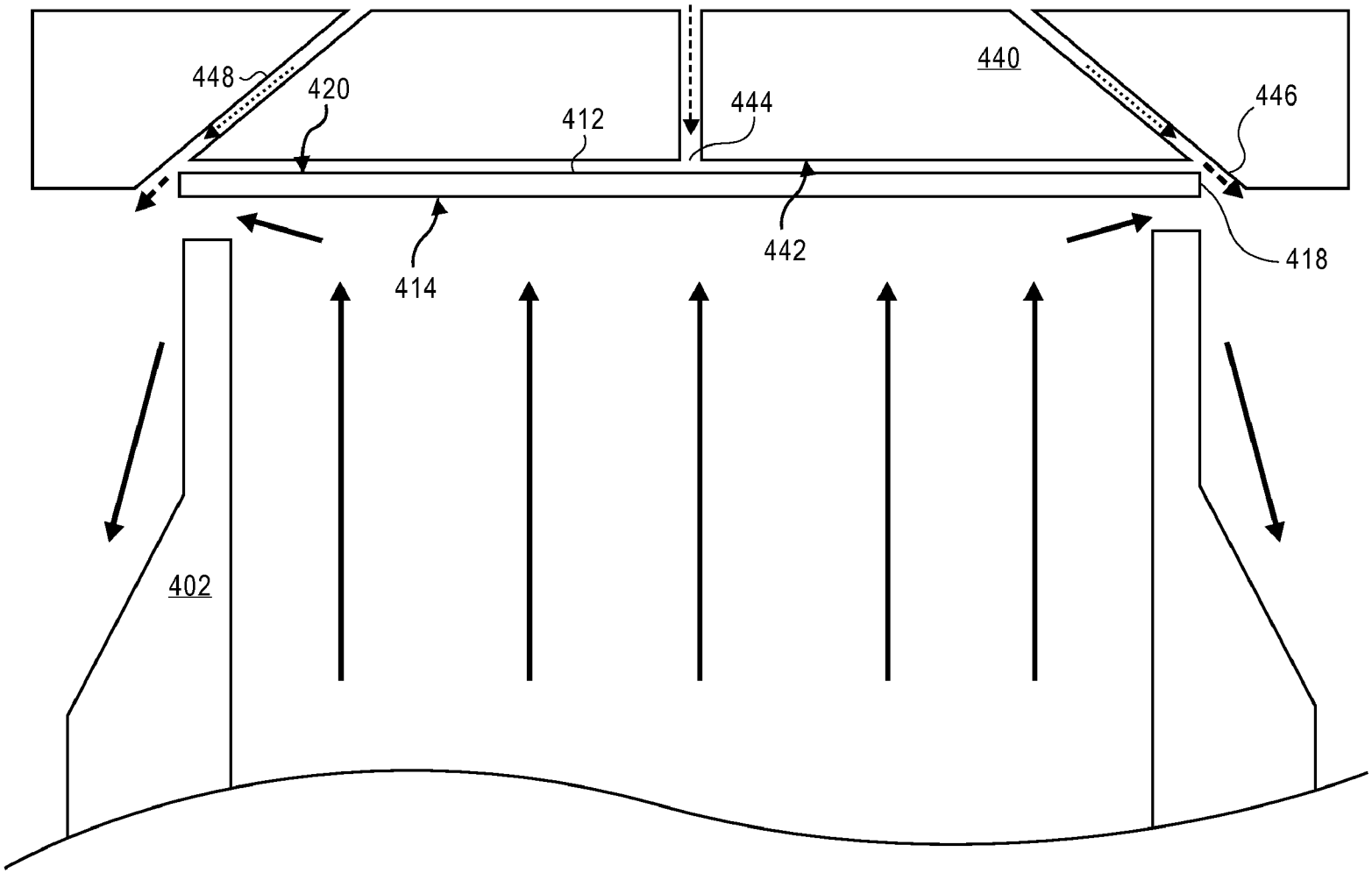
FIG. 4 illustrates a schematic block diagram in cross-sectional side view of a portion of a fountain plating apparatus having a Bernoulli gripper for holding a substrate undergoing plating, in accordance with an embodiment of the present invention.

Electroplating apparatuses and methods for using the same to plate a surface of a substrate are described in association with FIGS. 2-4, in accordance with embodiments of the present invention. For purposes of clarity, many of the details of electroplating in general, and electroplating of substrates in particular, that are widely known have been omitted from the following description. In accordance with an embodiment of the present invention, a substrate is a thin, planar slice or wafer of material on which microelectronic or micromechanical devices can be formed. It is to be understood that the substrate may include any known semiconductor, dielectric or conductive material, and can have any regular, symmetrical or irregular geometry including, circular, notched, polygonal, square, semi-square or rounded square. In one embodiment, the substrate is a semi-square or rounded square semiconductor substrate, such as is used in the fabrication of photovoltaic solar cells.

A simplified, schematic diagram covering an embodiment of the fountain-type plating apparatus of the present invention is shown in FIGS. 2A, 2B and 2C, in accordance with an embodiment of the present invention. Referring to FIGS. 2A, 2B and 2C, the apparatus generally includes a double wall plating vessel 200 including an inner cup 202 and an outer cup 204 peripherally surrounding and spaced apart from inner cup 202. Inner cup 202 has an inlet 205 for receiving a plating solution from a reservoir or source, such as a pump 207, and an outlet 206 from which the plating solution overflows into a plenum 208 defined between inner and outer cups 202 and 204. In one embodiment, double wall plating vessel 200 is positioned in or above an overflow tank or tray 209 for catching effluent from plenum 208. Although shown as a single plating vessel 200 positioned within a single tray 209, it will be appreciated that the overflow is typically much larger than the double wall plating vessel, and thus a plating system or tool may include multiple plating vessels 200 positioned within a single tray.

Generally, the plating vessel 200 further includes a plurality of supports 210 (only two of which are shown) to support a substrate 212 at a predetermined position near outlet 206 of inner cup 204 such that the plating solution flowing from outlet 206 into plenum 208 passes over and uniformly plates a lower surface 214 of substrate 212. Supports 210 can be attached to and extend from inner cup 202 or outer cup 204 (as shown), or can be attached to and extend from mounts (not shown) outside both inner and outer cups 202 and 204. In an embodiment, attachment to external mounts or to outer cup 204 aids to reduce plating on supports 210.

In one aspect of the invention, an air-knife 299A (as shown directing air approximately vertically downward in FIG. 2A) or 299B (as shown directing air outward in FIG. 2B) or 299C (as shown providing clearance for substrate 212) including one or more outlets directs a plurality of streams of fluid, such as a stream of gas 216 past a peripheral edge 218 of substrate 212 towards plenum 208 at a flow rate selected to substantially prevent any plating occurring on the edge or a top surface 220 of substrate 212. Suitable fluids include any liquid or gas, such as air or nitrogen ($N_2$), that will not contaminate substrate 212 being processed or interfere with the plating process.

In accordance with an embodiment of the present invention, the outlets and the plurality of streams of gas 216 in air-knife 299A or 299B or 299C are configured to provide an adjustable and substantially uniform curtain of gas around the entire periphery of substrate 212. In one embodiment, the plating apparatus further includes a structure or mechanism for centering substrate 212 relative to air-knife 299A or 299B or 299C. In the embodiments shown in FIGS. 2A, 2B, 2C and 3, outer cup 204 or 304 peripherally surrounds and serves as a centering mechanism for substrate 212 or 312. Without such a centering structure or mechanism, a non-centered substrate 212 would impair the effectiveness of air-knife 299A or 299B or 299C. In certain embodiments, air-knife 299A or 299B or 299C further includes a plurality of point jets, in addition to those outlets configured to provide a uniform curtain around the periphery of substrate 212, to change the gas flow in a vicinity of supports 210. Such an arrangement may accommodate any detrimental effects of supports 210 on gas flow from air-knife 299A or 299B or 299C.

In one embodiment, as is depicted in FIGS. 2A, 2B and 2C, the plating apparatus is an electroplating apparatus in which inner cup 202 is electrically insulated or made of a non-conducting material, and further includes an electrical power supply 222 having a first, positive terminal electrically coupled to an electrode or anode 224 positioned with the plating solution in the inner cup. A second terminal is electrically coupled to substrate 212, which serves as a cathode of the electroplating cell. In certain embodiments, such as the embodiment depicted, the second terminal is electrically coupled to substrate 212 through one or more electrically conducting supports 210. In an alternative embodiment, supports 210 are not electrically conducting and the electroplating apparatus includes a plurality of separate electrical contacts to contact substrate 212. For example, in a specific embodiment, electrical contact to substrate 212 is made through a chuck, platen or gripper to which the edge or a top surface 220 of substrate 212 is held.

In embodiments for which the plating apparatus is an electroplating apparatus, the plating solution is an electrolytic solution that facilitates the transfer of metal ions to the lower surface 214 of substrate 212. The source of the metal ions, which may include, but is not limited to, tin, nickel, titanium, tantalum, aluminum, chromium, gold, silver, copper, or alloys thereof, may be from a consumable anode, or a non-consumable anode with a source attached thereto. For example, in an embodiment, a non-consumable anode is used and the metal ions come from an external source, such as an anode bag 225 attached to or resting on anode 224.

In another aspect of the invention, inner cup 202 further includes an outer surface 226 or portion of the outer surface near outlet 206 facing outer cup 204 that is shaped to substantially reduce accumulation of plating solution near the edge 218 of substrate 212. This arrangement may further reduce plating on the edge 218 or the top surface 220 of substrate 212. In one embodiment, as shown in FIGS. 2A, 2B and 2C, this outer surface 226 includes a beveled edge sloping towards outlet 206 to create a larger cavity or opening in plenum 208.

In another embodiment, shown in FIG. 3, an outer surface 326 of an inner cup 302 includes an undercut rim near an outlet 306 to control flow of plating solution into a plenum 308 through surface tension. In one embodiment, in order to enhance the effect of surface tension, both a lip above the undercut outer surface 326 and the surface itself form a continuous smooth surface, as depicted in FIG. 3.

Referring again to FIG. 3, in yet another aspect of the invention, the apparatus further includes a plurality of ports located and oriented to direct streams of fluid, such as a stream of gas 328, towards plenum 308. In an embodiment, the streams of gas redirect plating solution away from the edge 318 of substrate 312, thereby further reducing plating on the edge 318 and top surface 320 of substrate 312. In an embodiment, an air-knife (represented by flow 316) directs suitable fluids, such as but not limited to a liquid or gas (such as air or $N_2$), which will not contaminate substrate 312 being processed or interfere with the plating process. In one version of this embodiment, the stream of fluid may include the same electrolytic solution as introduced into inner cup 302. In certain embodiments, as shown, outer cup 304 includes two or more portions, including a lower outer cup 304*a* and an upper outer cup 304*b*, and the mating surfaces between the lower and an upper outer cup portions are configured to define the plurality of ports 330 located and oriented to direct streams of gas 328 towards plenum 308.

In another aspect of the invention, the apparatus further includes a Bernoulli gripper, which uses the lower pressure created by a fluid, such as air or gas, moving across a surface of the substrate to hold it against a mounting surface of the gripper in a predetermined position near the outlet or surface of a plating vessel. In the present invention, the mounting surface of the Bernoulli gripper is further designed to provide an adjustable and substantially uniform flow of gas around the entire periphery of the substrate in order to substantially prevent any plating occurring on the edge or on a top surface of the substrate.

One such embodiment of a Bernoulli gripper is shown schematically in FIG. 4, in accordance with an embodiment of the present invention. Referring to FIG. 4, a Bernoulli gripper 440 generally includes a planar surface 442 to which an upper surface 420 of a substrate 412 is held. The one or more gas outlets 444 in the planar surface 442 are arranged to direct a gas flow onto of the upper surface 420 of substrate 412 causing the gas to flow outwardly to a peripheral edge 418 of substrate 412. In an embodiment, this arrangement creates a pressure above substrate 412 that is less than the pressure below substrate 412. In one embodiment, the pressure difference is applied to hold substrate 412 in a steady position. In an embodiment, as shown, the planar surface 442 is a recess in Bernoulli gripper 440 including interior side surfaces 446 that serve to center substrate 412. In a specific embodiment, the recess is used to redirect gas flowing from between substrate 412 and the planar surface downward across the periphery or peripheral edge 418 of substrate 412. In an embodiment, this arrangement substantially prevents any plating occurring on the edge 418 or top surface 420 of substrate 412.

It will be appreciated that Bernoulli gripper 440 can be used with a double wall plating vessel having an inner cup and an outer cup, as described above with respect to FIGS. 2A, 2B, 2C and 3, or with a conventional, single wall or cup fountain plating apparatus as shown in FIG. 4. By maintaining a sufficient and uniform flow of gas across the periphery or peripheral edge 418 of substrate 412, plating occurring on the edge 418 or top surface 420 of substrate 412 is substantially eliminated. Optionally, Bernoulli gripper 440 can further include a plurality of additional gas ports or outlets 448, located near the peripheral edge 418 of substrate 412, and positioned and oriented to provide the desired flow of gas across the periphery or peripheral edge.

It will further be appreciated that Bernoulli gripper 440 can hold substrate 412 substantially without physically contacting substrate 412. Thus, in embodiments in which the plating apparatus is an electroplating apparatus or in which it is desirable to electrically couple to substrate 412, the apparatus can further include flexible electrical conductors (not shown) adapted to electrically couple to a substrate held on Bernoulli gripper 440 when substrate 412 is held in the predetermined position proximal to inner cup 402 or plating vessel 400. Such flexible electrical conductors can be mounted to extend upward from an inner or outer cup of the plating apparatus, or can descend from Bernoulli gripper 440.

Thus, a plating apparatus and method for plating a surface of a substrate have been disclosed. In accordance with an embodiment of the present invention, the apparatus includes a double wall plating vessel having an inner cup and an outer cup peripherally surrounding and spaced apart from the inner cup. The inner cup has an inlet for receiving a plating solution and an outlet from which the plating solution overflows into a plenum defined between the inner and outer cups. A plurality of supports support the substrate at a predetermined position proximal to the outlet of the inner cup so that the plating solution flowing from the outlet into the plenum passes over and plates the surface thereof. In one embodiment, an air-knife directs streams of gas past the edge of the substrate and towards the plenum to substantially prevent any plating occurring on a peripheral edge or opposing surface of the substrate.

What is claimed is:

1. An apparatus for plating a surface of a substrate, comprising:

a double wall plating vessel including an inner cup and an outer cup peripherally surrounding and spaced apart from the inner cup, the inner cup having an inlet for receiving a plating solution and an outlet from which the plating solution overflows into a plenum defined between the inner and outer cups;

a plurality of supports for supporting the substrate at a predetermined position proximal to the outlet of the inner cup so that the plating solution flowing from the outlet into the plenum passes over and uniformly plates the surface of the substrate;

an air-knife including a stream of gas directed to flow past a peripheral edge of the substrate positioned on the plurality of supports and towards the plenum; and a plurality of ports located proximal to the outlet of the inner cup and oriented to direct streams of gas into the plenum, redirecting plating solution away from the edge of the substrate.

2. An apparatus according to claim 1, wherein the outer cup comprises two portions including a lower outer cup and an upper outer cup, and wherein mating surfaces between the lower and upper outer cup are configured to define the plurality of ports located proximal to the outlet of the inner cup and oriented to direct streams of gas towards the plenum.

3. An apparatus according to claim 1, wherein the stream of gas of the air-knife substantially prevents any plating occurring on the edge or a top surface of the substrate.

4. An apparatus according to claim 1, wherein the apparatus is an electroplating apparatus and further comprises an electrical power supply having a first terminal electrically coupled to an electrode positioned within the plating solution in the inner cup and a second terminal electrically coupled to the substrate.

5. An apparatus for plating a surface of a substrate, comprising:

a double wall plating vessel including an inner cup and an outer cup peripherally surrounding and spaced apart from the inner cup, the inner cup having an inlet for receiving a plating solution and an outlet from which the plating solution overflows into a plenum defined between the inner and outer cups, wherein the inner cup further comprises an outer surface near the outlet thereof, facing the outer cup, and shaped to substantially reduce accumulation of plating solution near the edge of the substrate, wherein the outer surface near the outlet of the inner cup comprises a rounded edge to control flow, through surface tension, of plating solution into the plenum, and wherein the outer surface near the outlet of the inner cup comprises an undercut rim near the outlet to control flow, through surface tension, of plating solution into the plenum;

a plurality of supports for supporting the substrate at a predetermined position proximal to the outlet of the inner cup so that the plating solution flowing from the outlet into the plenum passes over and uniformly plates the surface of the substrate;

an air-knife including a stream of gas directed to flow past a peripheral edge of the substrate positioned on the plurality of supports, the air-knife comprising an opening to further direct the stream of gas into the plenum; and a plurality of ports located proximal to the outlet of the inner cup and oriented to direct streams of gas into the plenum, redirecting plating solution away from the edge of the substrate.

6. An apparatus according to claim 1, wherein the stream of gas of the air-knife substantially prevents any plating occurring on the edge or a top surface of the substrate.

7. An apparatus according to claim 1, wherein the air-knife comprises a plurality of streams of gas from a plurality of discreet outlets that interact form a continuous curtain of gas flowing past the peripheral edge of the substrate.

8. An apparatus according to claim 5, further including a centering structure to align the edge of the substrate relative to the air-knife.

9. An apparatus according to claim 5, wherein the outer cup comprises two portions including a lower outer cup and an upper outer cup, and wherein mating surfaces between the lower and upper outer cup are configured to define the plurality of ports located proximal to the outlet of the inner cup and oriented to direct streams of gas towards the plenum.

10. An apparatus according to claim 5, wherein the apparatus is an electroplating apparatus and further comprises an electrical power supply having a first terminal electrically coupled to an electrode positioned within the plating solution in the inner cup and a second terminal electrically coupled to the substrate.

* * * * *